US005984630A

United States Patent [19]

Di Salle et al.

[11] Patent Number: 5,984,630

[45] Date of Patent: Nov. 16, 1999

[54] REDUCED WINDAGE HIGH PRESSURE TURBINE FORWARD OUTER SEAL

[75] Inventors: David A. Di Salle, Hamilton; Robert Proctor; Edward P. Brill, both of West Chester; Steven A. Ross, Cincinnati, all of Ohio; Robert J. Albers, Park Hills, Ky.; John C. Brauer, Lawrenceburg, Ind.; Gulcharan S. Brainch, West Chester; Dean T. Lenahan, Cincinnati, both of Ohio

[73] Assignee: General Electric Company, Cincinnati, Ohio

[21] Appl. No.: 08/997,833

[22] Filed: Dec. 24, 1997

[51] Int. Cl.[6] ..... F01D 11/02; F03B 11/00

[52] U.S. Cl. ..... 415/174.5; 277/418

[58] Field of Search ..... 415/171.1, 173.1, 415/173.7, 174.5, 173.5, 173.4, 174.4; 277/415, 418, 419

[56] References Cited

U.S. PATENT DOCUMENTS

| | | | |
|---|---|---|---|
| 3,989,410 | 11/1976 | Ferrari | 415/173.7 X |
| 4,466,239 | 8/1984 | Napoli et al. | 415/173.7 X |
| 4,513,975 | 4/1985 | Hauser et al. | 277/415 |
| 4,662,821 | 5/1987 | Kervistin et al. | 415/174.5 |
| 4,668,163 | 5/1987 | Kervistin | 415/116 |
| 5,190,440 | 3/1993 | Maier et al. | 415/174.5 |
| 5,224,713 | 7/1993 | Pope | 415/173.5 X |
| 5,281,090 | 1/1994 | Starling | 415/173.7 |
| 5,586,860 | 12/1996 | Bertrand et al. | 415/174.5 X |

FOREIGN PATENT DOCUMENTS

| | | | |
|---|---|---|---|
| 995189 | 6/1965 | United Kingdom | 415/174.5 |

*Primary Examiner*—John E. Ryznic
*Attorney, Agent, or Firm*—Andrew C. Hess; Rodney M. Young

[57] ABSTRACT

A blocker and swirl inducer hole configuration for use in connection with a high pressure turbine is described. In one embodiment, the blocker holes are oriented to a 45-degree tangential angle with respect to the direction of rotation of the seal, which results in pre-swirling the air before being injected into the swirl cavity. In addition, the number of blocker holes is reduced by as much as 50% of the number of blocker holes used in the known CFM56 turbine. Further, rather than injecting the air into the first swirl cavity as is known, the air is injected into a second swirl cavity. The combined effect of orienting the holes to the 45-degree tangential angle with respect to the direction of rotation of the seal, locating the holes to open into the second swirl cavity, and reducing the flow area by about 50%, results in an increase in blocker hole pressure ratio. Increasing the blocker hole pressure ratio results in a higher hole exit velocity which maximizes the cavity inlet swirl. The blocker holes therefore not only provide back-pressure, but also function as swirl-inducers. By inducing swirl into the air injected into the second swirl cavity, better turbine disk rim cooling effectiveness is provided. This result facilitates maintaining reasonable metal temperatures at increasingly severe cycle conditions without the normally expected engine performance penalties.

8 Claims, 2 Drawing Sheets

REDUCED WINDAGE HIGH PRESSURE TURBINE FORWARD OUTER SEAL

FIELD OF THE INVENTION

This invention relates generally to gas turbine engines and more particularly, to a reducing the frictional heating of air passing through a forward outer seal in a high pressure turbine.

BACKGROUND OF THE INVENTION

Gas turbine engines generally include a high pressure compressor for compressing air flowing through the engine, a combustor in which fuel is mixed with the compressed air and ignited to form a high energy gas stream, and a high pressure turbine. The high pressure compressor, combustor and high pressure turbine sometimes are collectively referred to as the core engine. Such gas turbine engines also may include a low pressure compressor, or booster, for supplying compressed air, for further compression, to the high pressure compressor.

If the disk rim temperature in the high pressure turbine approaches operational limits, rim cavity cooling systems are necessary. Low friction devices such as windage covers and straight or step-up seals have been used to control cooling temperatures and thereby protect critical components from increasingly severe engine cycle conditions. In addition, a combination of forward outer seal (FOS) flow and FOS bypass flow have been used to supply the forward rim cavity with reasonably cool air. The FOS bypass flow is effective because such flow is not affected by the friction heating in the seal. Such bypass flow, however, reduces performance of the high pressure turbine and high pressure turbine blade cooling flow.

FIG. 1 is a schematic illustration of a portion of a CFM56 turbine 10 including a known blocker hole configuration. Turbine 10 includes rotating components 12 and stationary components 14 as is known. One of rotating components 12, for example, is a seal 16. A plurality of flow paths extend through at least portions of turbine 10, such as a forward outer seal (FOS) flow 18 and a FOS bypass flow 20. Flow path 18 extends, for example, through a first swirling cavity 22 between seal 16 and stationary components 14 to a forward rim cavity 24. Air is supplied to flow path 18 from both seal compressor delivery pressure (CDP) exit air 26 and nozzle cooling air 28. Air is supplied to FOS bypass flow from CDP seal exit air 26.

As shown in FIG. 1, a blocker hole 30 is formed in stationary component 14, and seal exit air 26 flows through blocker hole 30 into first swirling cavity 22. Airflow through blocker hole 30 provides back-pressure to seal 16 and limits the leakage of high pressure turbine blade cooling air through seal 16. In practice, and in the CFM56 turbine, a plurality of blocker holes 30 are provided.

Airflow through blocker holes 30, however, results in injecting unswirled air into first swirling cavity 22. As a result, rotating seal 16 imparts more net torque on, and therefore more heat into, the cavity air. Injecting more heat into the cavity results in reducing the performance of the high pressure turbine and high pressure turbine blade cooling flow.

As performance targets become more aggressive, the FOS bypass flow must be reduced or eliminated. Of course, reducing or eliminating such flow should not adversely affect satisfying the cooling requirements.

SUMMARY OF THE INVENTION

These and other objects may be attained by a blocker and swirl inducer hole configuration in accordance with the present invention. More particularly, and in one embodiment, the blocker holes are oriented to a 45-degree tangential angle with respect to the direction of rotation of the seal, which results in pre-swirling the air before being injected into the swirl cavity. In addition, the number of holes is reduced by as much as 50% of the number of blocker holes used in the known CFM56 turbine. Further, rather than injecting the air into the first swirl cavity as is known, the air is injected into a second swirl cavity.

The combined effect of orienting the holes to the 45-degree tangential angle with respect to the direction of rotation of the seal, locating the holes to open into the second swirl cavity, and reducing the flow area by about 50%, results in an increase in blocker hole pressure ratio. Increasing the blocker hole pressure ratio results in a higher hole exit velocity which maximizes the cavity inlet swirl.

The above described blocker holes therefore not only provide back-pressure, but also function as swirl-inducers. By inducing swirl into the air injected into the second swirl cavity, better turbine disk rim cooling effectiveness is provided. This result facilitates maintaining reasonable metal temperatures at increasingly severe cycle conditions without the normally expected engine performance penalties.

DETAILED DESCRIPTION

The present invention is believed to be particularly useful in connection with high pressure turbines such as the CFM56 HP Turbine commercially available from General Electric Company, Cincinnati, Ohio. The present invention can, however, be utilized in connection with other high pressure turbines and is not limited to practice in the specific turbine configuration described below.

Figure 1:
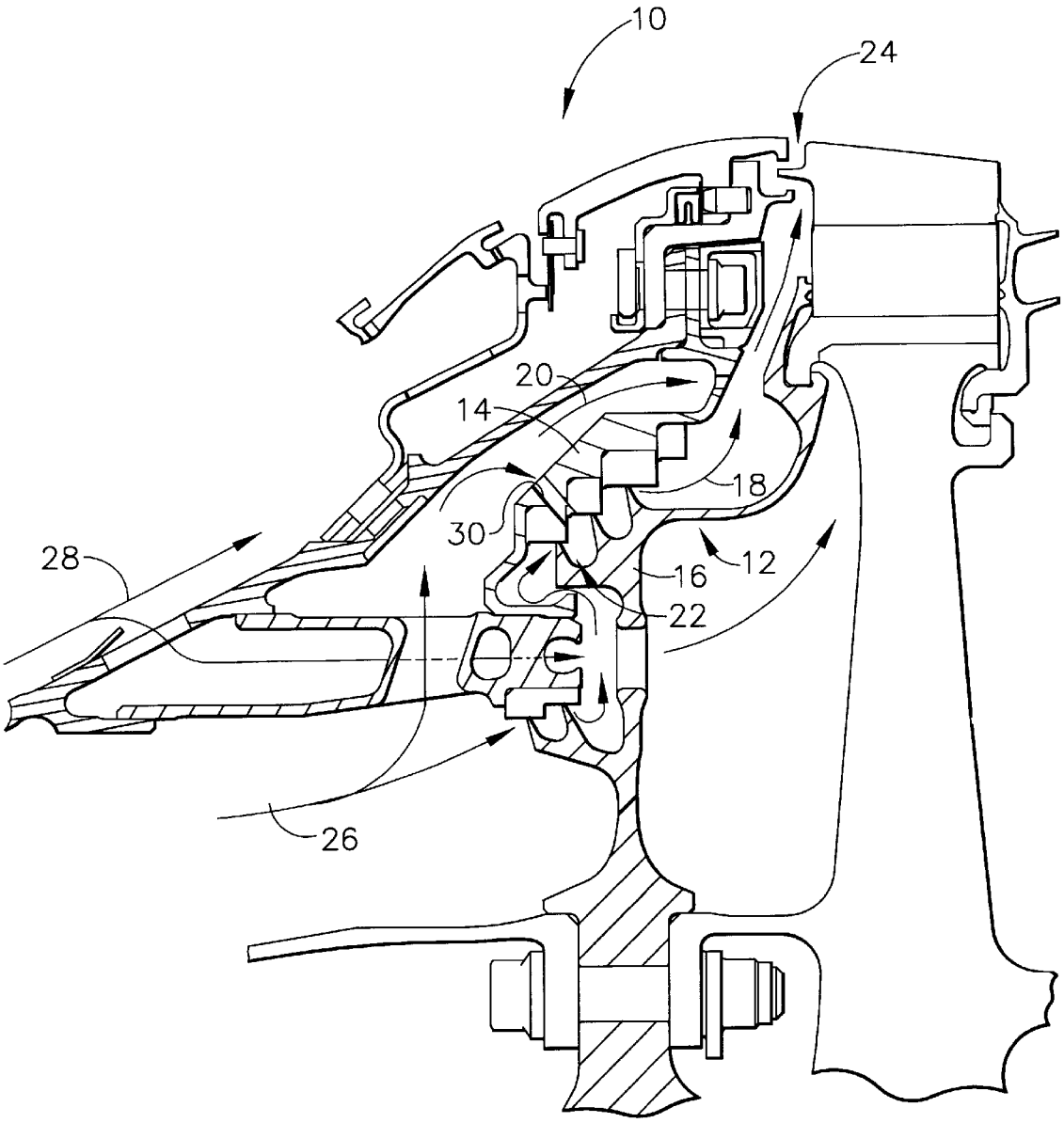
FIG. 1 (PRIOR ART)
FIG. 1 is a schematic illustration of a turbine disk rim including a known blocker hole configuration.
Figure 2:
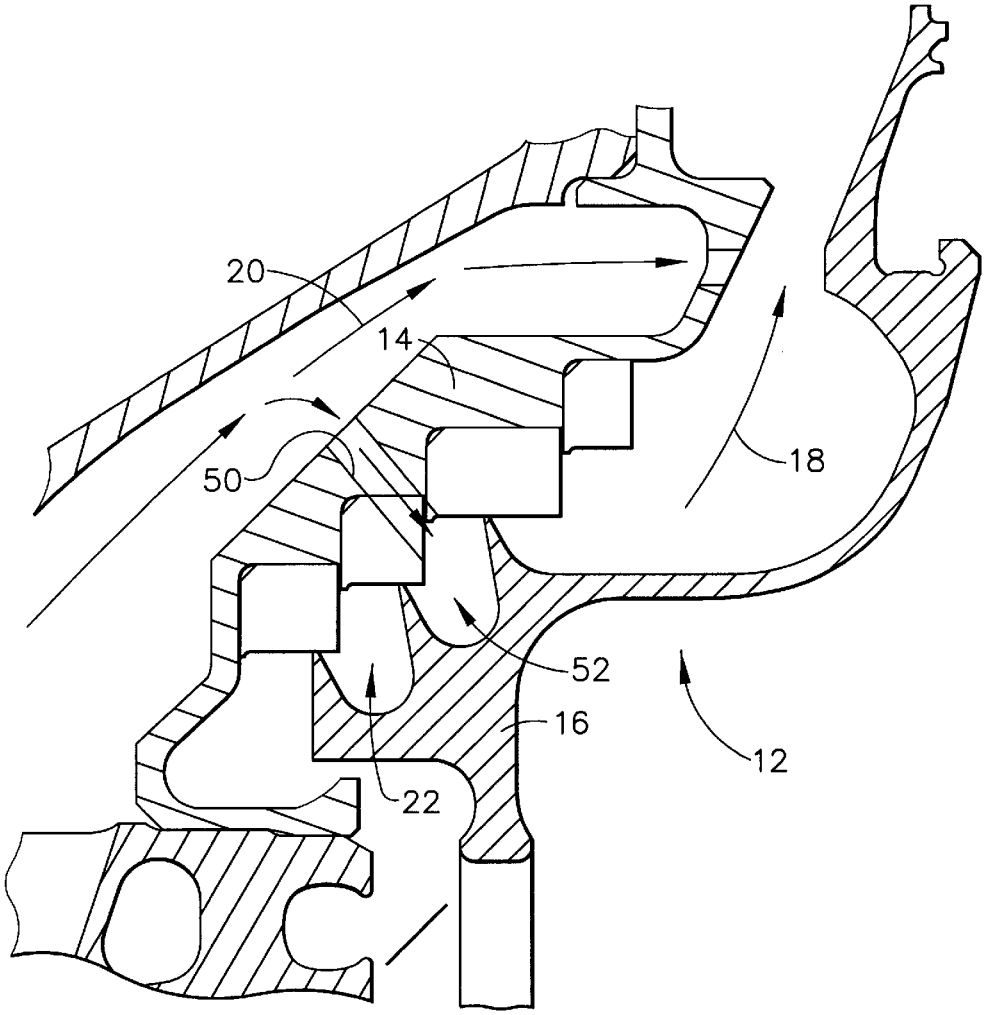
FIG. 2 is a schematic illustration of a turbine disk rim including a blocker and swirl inducer hole configuration in accordance with one embodiment of the present invention.

FIG. 2 is a schematic illustration of a blocker and swirl inducer hole 50 configuration in accordance with one embodiment of the present invention. More particularly, rather than injecting air into first swirl cavity 22, air is injected into second swirl cavity 52. In addition, blocker hole 50 is oriented to a 45-degree tangential angle with respect to the direction of rotation of seal 16, which results in pre-swirling the air before being injected into second swirl cavity 52. Further, the number of holes 50 is reduced by as much as 50% of the number of holes 30 (FIG. 1) used in the known CFM56 turbine.

The combined effect of orienting holes 50 to the 45-degree tangential angle with respect to the direction of rotation of seal 16, locating holes 50 to open into second swirl cavity 52, and reducing the flow area by about 50%, results in an increase in blocker hole pressure ratio. Increasing the blocker hole pressure ratio results in a higher hole exit velocity which maximizes the cavity inlet swirl.

Blocker holes 50 therefore not only provide back-pressure, but also function as swirl-inducers. By inducing swirl into the air injected into second swirl cavity 52, better turbine disk rim cooling effectiveness is provided. This result facilitates maintaining reasonable metal temperatures at increasingly severe cycle conditions without the normally expected engine performance penalties.

It is contemplated, of course, that blocker holes 50 could extend at angles other than 45 degrees with respect to a direction of rotation of seal 16. In addition, rather than opening into second cavity 52, tangentially oriented holes 50 could open into first cavity 22 and still provide some benefits.

In addition, more than two swirl cavities can be formed between seal 16 and stationary components 14. For example, three or more swirl cavities can be provided. If more than two swirl cavities are formed, the flow can be directed to a swirl cavity at the downstream end of the seal.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

We claim:

1. A high pressure turbine comprising:

a stationary component;

a rotating seal, first and second swirl cavities between said stationary component and said rotating seal; and a plurality of blocker holes extending through said stationary component and opening into said second cavity so that a forward outer seal bypass flow is supplied to said second cavity during turbine operation.

2. A high pressure turbine in accordance with claim 1 wherein at least some of said blocker holes are tangentially oriented at an angle of about 45 degrees with respect to a direction of rotation of said seal.

3. A high pressure turbine in accordance with claim 1 wherein air flowing through said blocker holes is swirled as a result of flowing therethrough.

4. A high pressure turbine comprising:

a stationary component;

a rotating seal, first and second swirl cavities between said stationary component and said rotating seal; and a plurality of blocker holes extending through said stationary component and opening into at least one of said first and second cavities, at least some of said blocker holes tangentially oriented at an angle of about 45 degrees with respect to a direction of rotation of said seal so that a forward outer seal bypass flow is supplied to said second cavity during turbine operation.

5. A high pressure turbine in accordance with claim 4 wherein said blocker holes open into said second cavity.

6. A high pressure turbine in accordance with claim 4 wherein air flowing through said blocker holes is swirled as a result of flowing therethrough.

7. A high pressure turbine comprising:

a stationary component;

a rotating seal, a plurality of swirl cavities between said stationary component and said rotating seal, a first swirl cavity upstream of said other swirl cavities; and a plurality of blocker holes extending through said stationary component and opening into one of said cavities downstream from said first swirl cavity, at least some of said blocker holes tangentially oriented at a selected angle with respect to a direction of rotation of said seal so that air flowing through said blocker holes is swirled as a result of flowing therethrough so that a forward outer seal bypass flow is supplied to at least one of said other swirl cavities during turbine operation.

8. A high pressure turbine in accordance with claim 7 wherein said selected angle is approximately 45 degrees.

* * * * *